United States Patent [101]

Malone et al.

[11] 4,052,861

[45] Oct. 11, 1977

[54] INFLATABLE SECURING ARRANGEMENT

[75] Inventors: Billy C. Malone; Malcolm G. Coone, both of Houston, Tex.

[73] Assignee: Lynes, Inc., Houston, Tex.

[21] Appl. No.: 603,138

[22] Filed: Aug. 4, 1975

[51] Int. Cl.[2] ..... E02B 17/00

[52] U.S. Cl. ..... 61/86; 61/94; 61/96; 24/263 R; 294/86.15

[58] Field of Search ..... 61/46.5, 53.72, 86, 61/94, 96; 24/263 DH, 263 DT, 263 KS, 263 DG; 294/86.15, 86.26, 86.32

[56] References Cited

U.S. PATENT DOCUMENTS

| | | | |
|---|---|---|---|
| 1,586,923 | 6/1926 | Townsend | 24/263 DH |
| 2,934,804 | 5/1960 | Suderow | 61/46.5 X |
| 3,468,132 | 9/1969 | Harris | 61/63 |

*Primary Examiner*—Jacob Shapiro
*Attorney, Agent, or Firm*—William C. Norvell, Jr.

[57] ABSTRACT

An inflatable securing arrangement includes support means having a longitudinally extending annular elastomer body bonded thereto. An annular reinforcing is also secured to the support means and extends longitudinally thereof, and gripping means are carried by the support means, such gripping means extending longitudinally within the elastomer body whereby movement of the elastomer body by fluid pressure inwardly relative to the support means urges the gripping means inwardly relative to the support means for engaging an object positioned in the support means.

5 Claims, 16 Drawing Figures

INFLATABLE SECURING ARRANGEMENT

CROSS REFERENCE TO RELATED APPLICATION

The present invention relates to a structure which may be employed in the invention of Malcolm G. Coone and Erwin E. Hoffman, assigned to the assignee of this invention. Such invention is for "Grouting System and Arrangement for Offshore Structure," application Ser. No. 603,029 filed on Aug. 4, 1975.

SUMMARY OF THE INVENTION

In some circumstances it is desirable to telescopically position tubular member relative to each other and secure them together. In remote locations, such as water covered areas in connection with offshore mining and drilling operations, it is desirable to secure tubular members together, and the inaccessibility, or difficulty of securing such members together under such conditions can present various problems.

The present invention is directed to an arrangement which enables tubular members to be telescopically received one within the other, and then for securing the member together.

Another object of the present invention is to provide a securing arrangement including support means, an annular elastomer body carried by the support means and gripping means carried by the support means and extending longitudinally of the annular elastomer body, with means for supplying fluid under pressure to expand the elastomer body and gripping means inwardly relative to the support means for gripping and securing an object positioned in the support means.

Another object of the present invention is to provide a securing arrangement including support means, an annular elastomer body carried by the support means and gripping means carried by the support means and extending longitudinally of the annular elastomer body, with means for supplying fluid under pressure to expand the elastomer body and gripping means inwardly relative to the support means for gripping and securing an object positioned in the support means, the elastomer body serving to seal off between the support means and the object engaged by the gripping means.

Still another object of the present invention is to provide an arrangement for securing a pair of member together including longitudinally spaced annular members for connecting to the interior of one of the members, an annular elastomer body bonded to and extending between the annular members, an annular reinforcing sheath secured to and extending between the annular members, grip support means for connecting to the interior of the tubular member, and gripping means secured to the grip support means and extending longitudinally of and within the annular reinforcing sheath whereby movement of the annular elastomer body and reinforcing sheath inwardly relative to the tubular member on which they are positioned urges the gripping means inwardly thereof to engage the other tubular member.

The present invention has many applications, a few of which are discussed herein. However, such are given for illustration and example only, and are not intended to limit the scope of the invention.

Other objects and advantages of the present invention will become more readily apparent from a consideration of the following description and drawings.

DESCRIPTION OF THE PREFERRED EMBODIMENTS

Figure 2A:
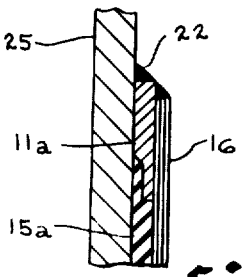
FIG. 2A is a partial sectional view illustrating a slightly modified form of elastomer body and reinforcing arrangement.
Figure 2:
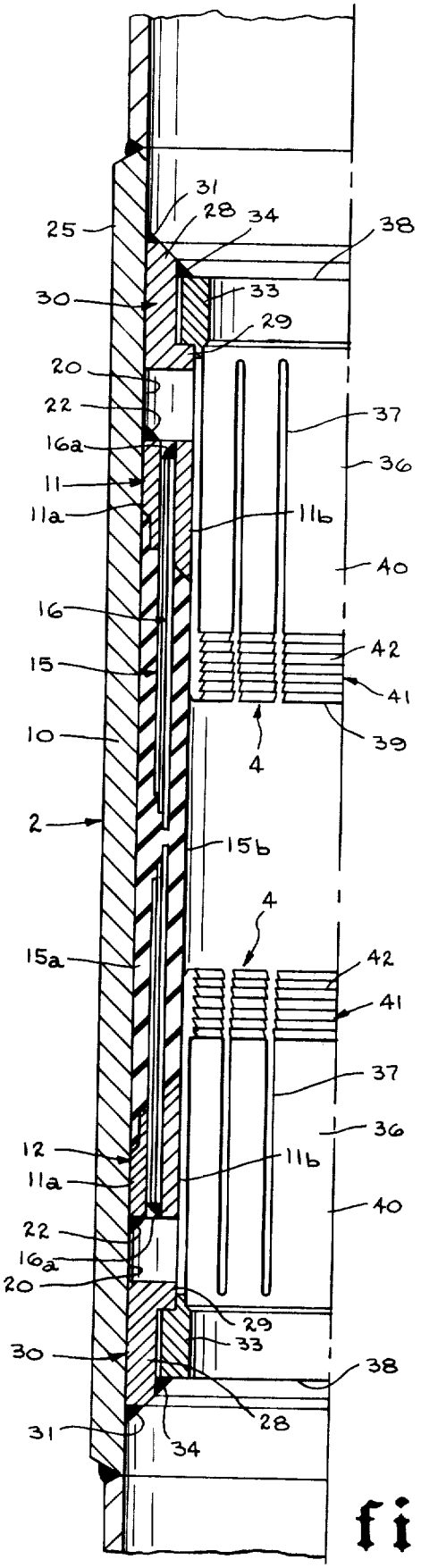
FIG. 2 is partial longitudinal sectional view illustrating one form of the invention.

Attention is first directed to FIG. 2 wherein a form of the present invention is illustrated. It can be appreciated that in some instances the present invention will be employed only as a gripping or securing arrangement, and in other situations it may be employed as both a securing and sealing arrangement. Broadly, the present invention includes support means referred to generaly at 2, an annular elastomer body 15 and gripping means 4.

In FIG. 2, the support means 2 is shown as including the annular longitudinally extending hollow body 10 which may be a portion of a tubular member 25. Annular members referred to at 11 and 12 are provided and are adapted to be secured in spaced relation as illustrated in the drawings on the interior 20 of tubular member 25 whereby the elastomer body referred to generally at 15 may be bonded thereto. It will be noted that the elastomer body 15 as shown in the form of the invention illustrated in the drawings extends continuously between the spaced members 11 and 12. In addition, an annular reinforcing referred to at 16 may be employed. The reinforcing 16 comprises a pair of annular sheaths each having an end secured by suitable means such as welds 16a to the annular members 11 and 12. The other ends of the reinforcing 16 terminate in spaced relation to each other as shown in the drawings.

The elastomer body 15 may have the reinforcing 16 embedded therein, or the elastomer body 15 may comprise an annular outer covering 15a which encircles the annular reinforcing sheath 16 and then a separate inner tube or liner 15b may be provided which is within or encircled by the sheath 16 so that the reinforcing is in effect surrounded by the elastomer body 15 as shown. The elastomer body 15 is bonded at each of its ends to the annular members 11 and 12. In some instances, as shown in FIG. 2A, the inner tube may be omitted, or in some instances it may be desirable to omit the outer covering 15a and employ the reinforcing and the inner tube.

The annular members 11 and 12 are shown include the radially spaced annular rings 11a and 11b with the reinforcing 16 received between the rings 11a and 11b as shown in the drawings and welded thereto as referred to at 16a as previously described. The ring 11a of the annular members immediately adjacent the interior 20 of the tubular member 25 may be secured to such tubular member 25 by suitable means such as a weld 22 or the like. However, when the ring 11a, reinforcing 16 and ring 11b are all welded as described, they form a unitary structure.

Grip support means referred to generally at 30 are provided for connecting to the interior 20 of the tubular member 25 also. As shown, such grip support means includes a first annular member 28 of suitable configuration to provide an annular ledge 29 adjacent one end thereof. The first ring 28 is adapted to be secured to the interior 20 of the member 25 by any suitable means such as a weld 31 or the like.

A second ring 33 is seated on the ledge 29 and is secured by suitable means such as the weld 34 to the first ring 28 as shown in the drawings. Each of the rings 33 include an annular skirt 36 extending therefrom and telescopically received within each end of the elastomer body 15 as illustrated, therebeing one grip support means 30 being provided for securing adjacent each of the spaced annular members 11 and 12 as shown in the drawings. The annular skirt 36 depending from each of the rings 33 is slotted longitudinally and at circumferentially spaced intervals as shown at 37. The slots 37 extend in spaced relation from one end 38 of the ring 33 and intersect the other circumferential end or edge 39 of each of the rings 33 as shown.

The slotted arrangment of the skirst 36 provides a plurality of flexible fingers 40 which are telescopically received within each end of the elastomer body 15 as shown in the drawings and with the fingers 40 on each skirt terminating in spaced relation as illustrated. The end area 41 of each of the fingers 40 is provided with a plurality of circumferentially extending serrations or grooves 42 for defining a gripping surface for engaging a member or object received within the tubular body 10 and to be engaged by such gripping surfaces 42 as will be explained in greater detail.

As shown, the present invention is provided with gripping arrangements including the ring 33 and the skirt 36 with the fingers 40 at each end of the elastomer body 15; however, it can be appreciated that under some circumstances it may be desirable to provide only one of such rings 33 at one end of the body 15, in lieu of the two as shown and described.

Figure 10:
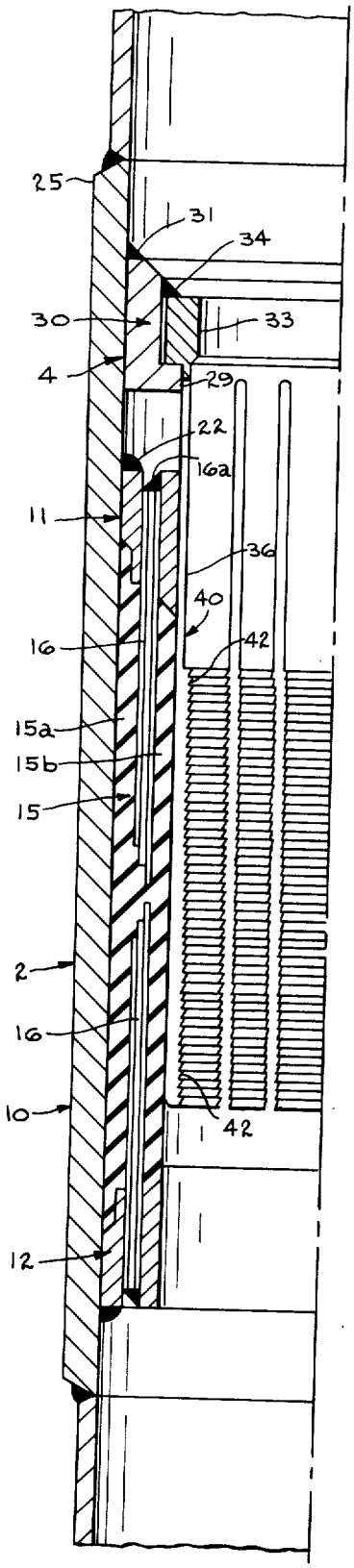
FIG. 10 is a partial sectional view showing a modified form of the invention.

For example, FIG. 10 illustrates such construction. The support means 2 includes the spaced annular members 11 and 12 secured to the support means as previously described. An elastomer body 15 is bonded to the members 11 and 12 and reinforcing 16 is provided. However, only one skirt 36 is carried by the support means 2, and the fingers 40 formed thereon have serrations or grooves 42 extending along a substantial longitudinal extent as shown for engaging and firmly gripping an object positioned in support means 2. Such construction may be employed when it is desired to primarily provide a gripping arrangement.

Figure 3:
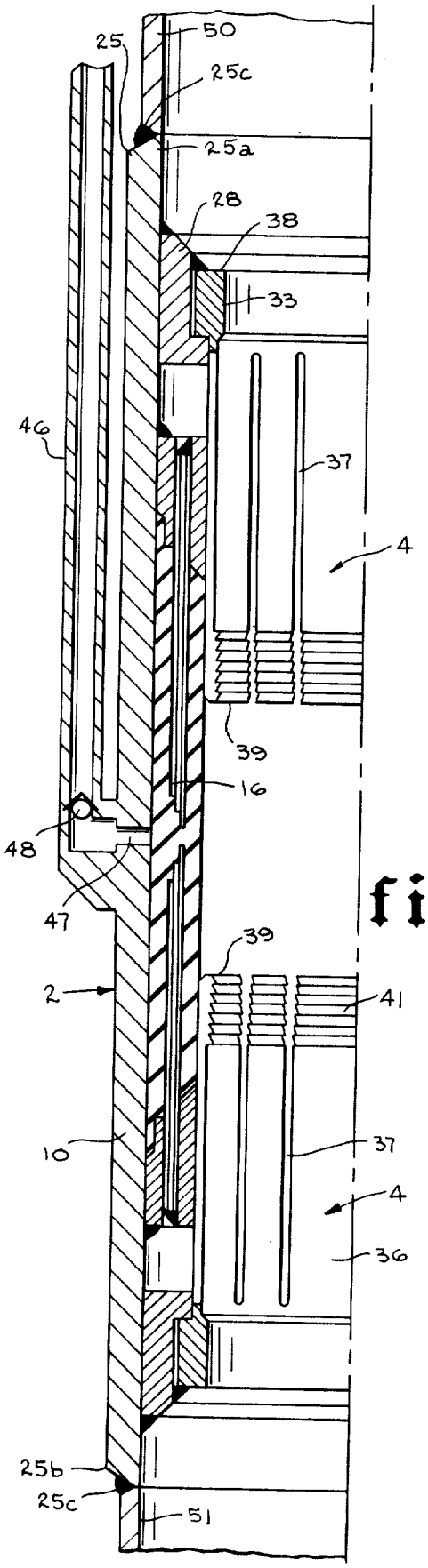
FIG. 3 is a longitudinal partial sectional view similar to FIG. 2 but illustrating means for supplying inflating fluid to the arrangement of the present invention.
Figure 4:
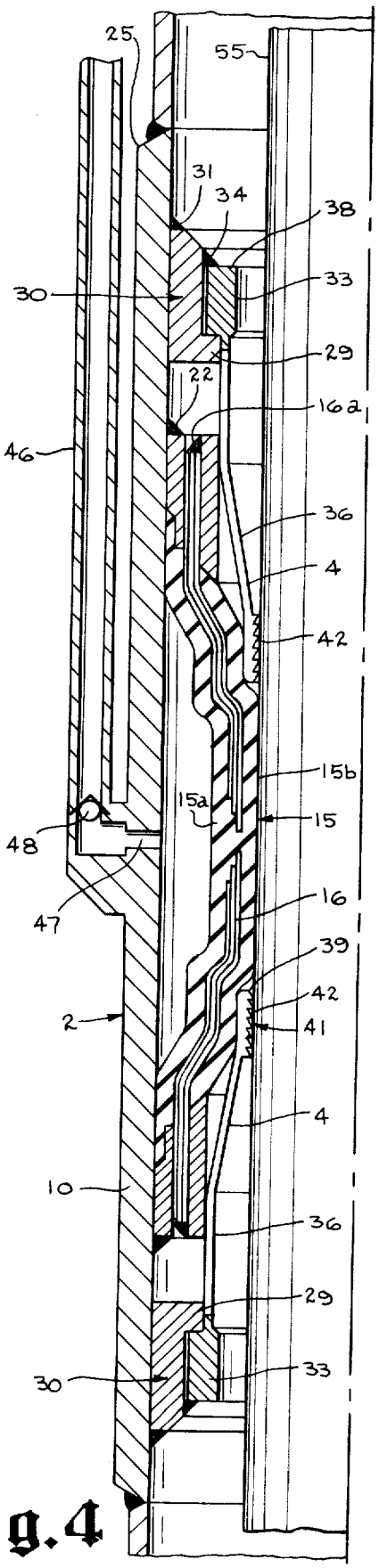
FIG. 4 illustrates a form of the present invention in its inflated position and secured and sealed with a member received int e support means of the present invention.

Some suitable means must be provided for causing the elastomer body 15 to move radially inwardly relative to the tubular body 25 upon which it is carried, and FIGS. 3 and 4 illustrate one suitable arrangement. Such arrangement includes conduit means 46 extending adjacent tubular body 25 and connected with passage means 47 extending through the support means 2, and if desired suitable one-way check valve means 48 may be provided in the conduit 46 so that after inflating pressure fluid is injected into the interior of the tubular body 25 to expand the elastomer body 15 and gripping means 4 inwardly as shown in FIG. 4 of the drawings, such fluid may be retained therein.

It will be noted that the tubular body 25 is shown as being connected at each of its ends 25a and 25b by suitable means such as a weld 25c to tubular members 50 and 51 respectively and may for purposes of description be considered as extensions of the body 25. Thus, the tubular body 25 with the sealing and securing arrangement of the present invention may be lowered to any desired depth in a water covered area as will be demonstrated and explained in detail hereinafter.

The inflating fluid provided through conduit 46 may be liquid, gas or a plastic mass such as cement from any suitable source and when it is discharged to the interior of the tubular body 25 or support means 2 between the spaced annular members 11 and 12, it acts against the elastomer body 15 to move it radially inwardly of the support means 2 whereupon the fingers 40 of gripping means 4 are also moved inwardly as shown in the drawings so that the surfaces 42 forming the gripping means may engage with a tubular member or other object illustrated at 55 in FIG. 4 which is telescopically received within the tubular body 25.

Figure 1:
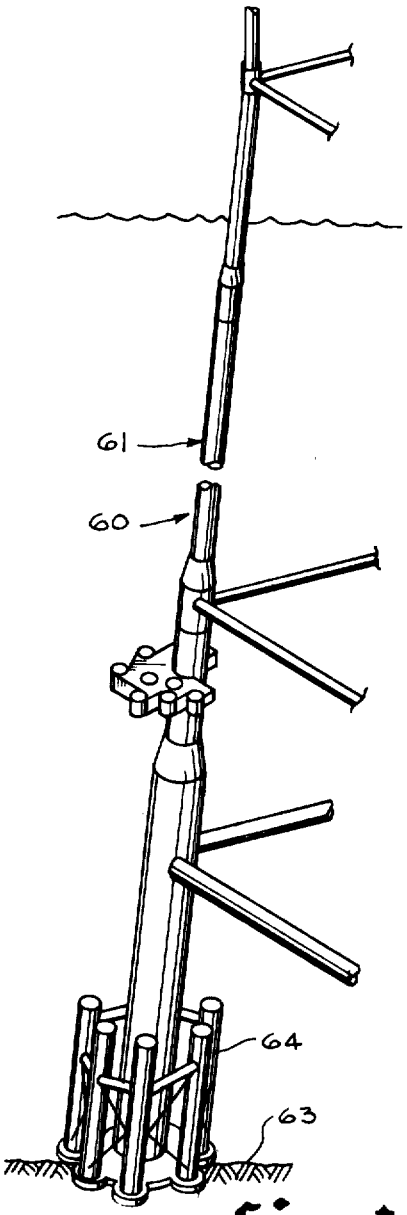
FIG. 1 is a partial perspective view of one leg of an offshore structure.

One application of the present invention may be in connection with grouting operations performed on offshore structures. In FIG. 1 an offshore structure is referred to generally at 60 wherein one of the legs 61 is partially shown. Such leg 61 normally rests on the seabed 63 and a plurality of tubular members 64 surround the leg adjacent the leg 61 at the seabed 63. It is then customary to drive piling (not shown) through the tubular members 64 into the surface in a water covered area and to then grout the space between the piling and the tubular members 64 to provide structural integrity between the piling and the structure.

The present invention may be positioned either adjacent the upper end or the lower end thereof or at any location longitudinally of the tubular member 64 depending upon the manner in which the grouting operations are to be performed. Not shown in the drawings are suitable conduits extending to the surface of the water whereby pressure may be supplied to the sealing and securing arrangement arranged on the tubular members 64 for inflation thereof to sealingly engage with the piling member which is in the tubular member 64 to close off the space therebetween. After such engagement and sealing, the grouting line (not shown) connected to the member 64 is supplied with grout or fluid pressure for displacing the water from the space between the piling and member 64 and then for providing grout to fill the annular space between the piling and the tubular member 64. One suitable grouting procedure is explained in the copending application above referred to.

Figure 5:
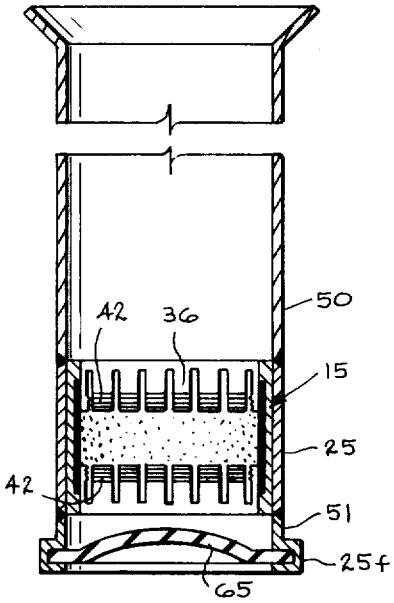
FIG. 5 illustrates an alternate form of the invention wherein a seal or closure means is employed with the support means at least at one end thereof.

In FIG. 5 it will be noted that the tubular members 50 and 51 in effect form extensions of the tubular body 25, as noted previously, and a suitable closure as shown at 65 is provided for one end of the tubular member 25 or support means 2. Such closure includes an annular elastomer member secured to the end 25f of tubular member 25 forming the support means 2.

Figure 6:
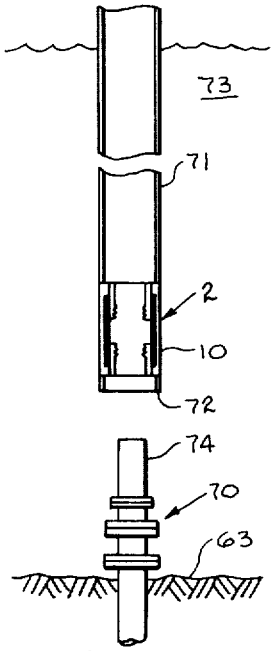
FIG. 6 illustrates the present invention employed with a marine riser for connecting and disconnecting with a subsea marine structure.

In FIG. 6 a seabed is illustrated again at 63 and a marine connection illustrated generally by the numeral 70 extends upwardly therefrom. A marine riser 71 is provided with the present invention adjacent the lower end 72 thereof so that such marine riser 71 may be lowered into the water covered area referred to at 73 and telescopically engaged with the upwardly extending portion 74 of the marine connection 70. When the portion 74 is telescoped within the support means 2 of the sealing and securing arrangement of the present invention, a conduit extending from the surface and connected into the opening 47 of the body 25 as described with regard to FIGS. 3 and 4 is provided with fluid pressure for expanding the elastomer body 15 inwardly to secure and seal the riser 71 with the marine structure 70.

Figure 7:
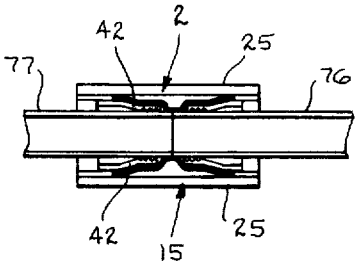
FIG. 7 is a diagrammatic illustration of the present invention illustrating the manner in which a pipeline may be tied together, or a damaged pipeline repaired.

In FIG. 7 the present invention is shown as employed for connecting a pair of members referred to at 76 and 77 together. The members 76 and 77 may represent a flow conduit which requires repairing, or a pipeline, or other suitable conducting means. It will be noted that the body 25 of the present invention is again provided with the arrangement 10 and includes the elastomer body 15 reinforcing 16 and other components described in detail with regard to FIG. 2. The inflating conduit 46 is not illustrated, as in FIG. 6, but the inflatable elastomer body 15 is adapted to move inwardly of the body 25 to engage the gripping means 42 with each end of the pair of members 76 and 77 as shown in FIG. 7 of the drawings to seal and secure therebetween.

Figure 8:
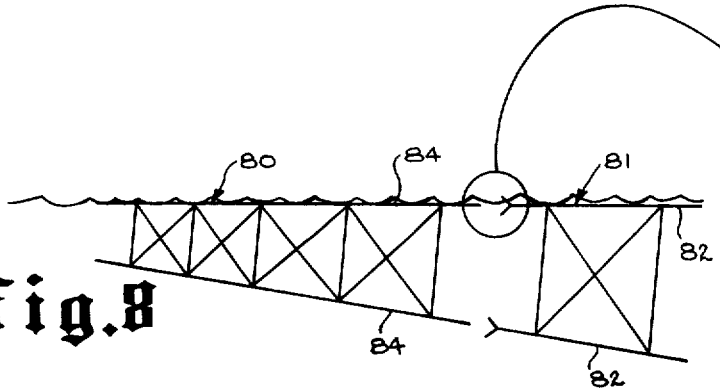
FIG. 8 schematically illustrates sections of a marine structure being floated to a desired location.
Figure 8A:
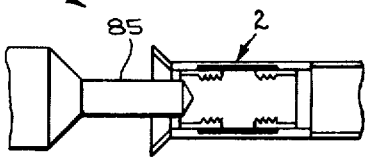
FIG. 8A is an enlargment of a portion of FIG. 8 illustrating a manner in which the sections of the marine structure may be secured together for sinking at a desired location in a water covered area.

In some situations in positioning marine platforms in water covered areas it may be desirable to float such structure in separate sections as represented at 80 and 81 in FIG. 8, and to then connect the sections 80 and 81 together adjacent the surface of the water prior to tilting the structure to position it on a submerged surface. FIG. 8A illustrates the support means 2 of the present invention as being associated with the legs 82 of the section 81 of the such structure for telescopically receiving the portion 85 of the legs 84 of the section 80 of the structure whereupon the portion 85 may be gripped in the manner as heretobefore described.

Figure 9:
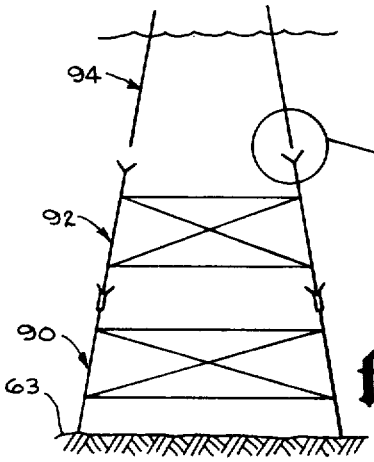
FIG. 9 schematically illustrates sections of a structure for use in water covered areas which are adapted to be lowered into the water and then secured together.
Figure 9A:
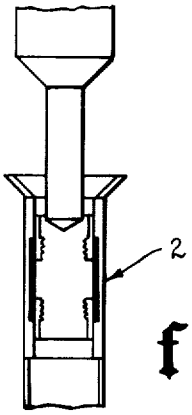
FIG. 9A is an enlargement of a portion of FIG. 9 illustrating the present invention diagrammatically and its manner of connecting the sections together.

In other situations a marine structure may be sunk in position on a submerged surface 63 in sections such as illustrated at 90, 92 and 94 in FIG. 9. This arrangement is similar to that described with regard to FIGS. 8 and 8A with the exception that the sections are joined together after the structure sections have been positioned section by section in the water on the seabed. In FIG. 9, the first two sections are shown as having been joined, while the uppermost section is shown just prior to joining with the inermediate section. As shown in FIG. 9A the support means 2 is associated with the legs of one structure section and the legs of the next adjacent structure section are adapted to be received therein.

Figure 11:
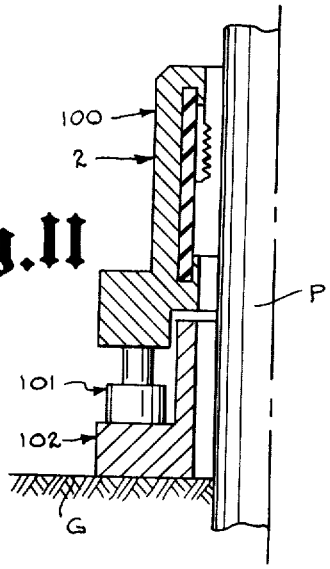
FIG. 11 is a partial sectional view illustrating the present invention used as a gripping or securing means.

In FIG. 11, an arrangement for exerting a longitudinal force on a member is illustrated. A piling P is shown as being driven into the ground G.

The present invention is shown generally at 100, and includes support means 2, the elastomer body and gripping means 4 which may be in the form as shown in FIG. 10.

Power means 101 carried on annular base 102 are provided for moving support means 2 longitudinally. Such power means may be of any suitable form such as hydraulic means and when the present invention is actuated to grip the piling P, the power source 101 may then be actuated to withdraw piling P from the ground G.

Figure 12:
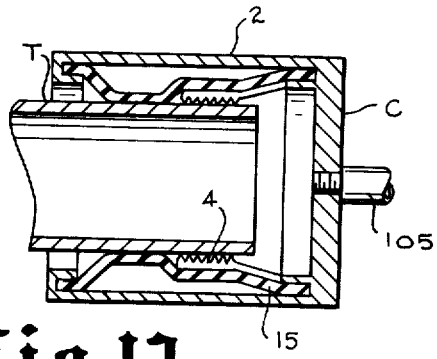
FIG. 12 is a partial view showing the present invention employed as a closure.

In FIG. 12, the present invention, is shown as functioning as a closure and test device. A tubular member T receives the support means 2 in the form of a cap C. The elastomer body 15 and gripping means 4 are mounted in the cap C to sealingly engage the tubular member T adjacent its ends to close it off. Thereafter hydrostatic pressure may be injected at 105 through cap C to test the tubular member T for burst strength.

Figure 13:
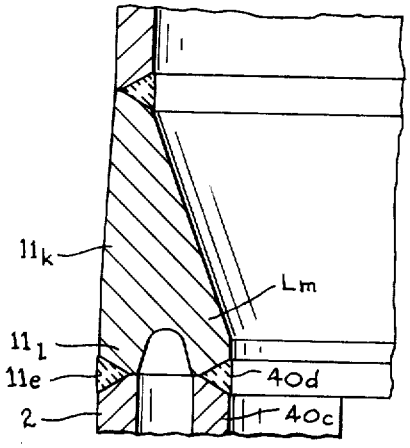
FIG. 13 shows still another form of the invention.

In FIG. 13 an alternate form of the invention is shown. In lieu of the annular members 11 and 12 a single member 11*k* is employed. The member 11*k* is formed with two annular, radially spaced end portions 11*l* and 11*m*. The outer annular edge 11*l* is secured by suitable means such as weld lle to the support means 2. The skirts 36 are omitted, and a plurality of fingers 40*c* are arranged in side by side relation and are welded at one end of their ends as shown at 40*d* to the annular end 11*m* of the member 11k. The members 40*c* are spaced circumferentially and extend circumferentially as well as longitudinally of support means 2 and are provided on their ends with gripping surfaces similar to surfaces 42 previously described.

With the members 11*k* and 40*c* mounted in spaced relation on each end of the support means 2, the fingers 40*c* at each end of the support means 2 form a group, with each group extending longitudinally in the ends of the elastomer body 15. The arrangement of FIG. 13 may be employed when only one group of fingers 40 are provided, as described with regard to FIG. 10.

In some instances, the elastomer body 15 may be bonded directly to the support means 2 and the reinforcing also welded directly to the support means thus eliminating the rings 11 and 12.

By completely closing the elastomer body 15 and gripping means 14, it is conceivable that the present invention could function as an internal closure or valve to close off internally in support means 2.

From the foregoing description and discussion, it can be seen that the present invention provides an arrangement for telescopically positioning of tubular members together and thereafter securing them in such telescoped relationship. In some situations such as illustrated in FIG. 2A, it is desirable to eliminate the inner tube 15*b* and employ only an outer covering of 15*a* and the reinforcing sheath 16. In other situations it will be desirable to employ both the inner tube or liner 15*b* an outer covering 15*a* and thereby form a sealing as well as a securing arrangement as shown in FIG. 4 of the drawings.

The foregoing disclosure and description of the invention are illustrative and explanatory thereof, and various changes in the size, shape, and materials as well as in the details of the illustrated construction may be made without departing from the spirit of the invention.

What is claimed is:

1. An inflatable securing arrangement comprising:

a. support means;

b. an annular elastomer body carried by said support means;

c. gripping means carried by said support means and extending longitudinally within said annular elastomer body whereby said elastomer body and gripping means may be moved inwardly relative to said support means; and d. reinforcing means extending longitudinally of said elastomer body, said reinforcing means having a pair of reinforcing sheaths each having first ends secured to said support means and second ends terminaing in spaced relation to each other.

2. The invention of claim 1 wherein said reinforcing sheaths are surround on each side by said annular elastomer body.

3. The invention of claim 1 wherein said reinforcing sheaths are positioned to contact said elastomer body and said gripping means.

4. The invention of Claim 1 wherein said reinforcing sheaths are positioned to contact said elastomer body and position said elastomer body between said gripping means and said reinforcing sheaths.

5. A single unit arrangement for exerting a securing force on a longitudinally extendable member including:

a. support means;

b. an annular elastomer body thereon and extendable therein:

c. gripping means carried by said support means and extending longitudinally of said annular elastomer body whereby said elastomer body and gripping means may be moved inwardly relative to said support means;

d. said support means including an annular longitudinally extending member;

e. conduit means for supplying fluid pressure between said annular member and said elastomer body for expansion of said elastomer body and gripping means inwardly of said support means to grip the longitudinally extending member; and f. power means for moving said annular member and engaged longitudinal member longitudinally.

* * * * *